United States Patent [19]

Simon et al.

[11] 4,272,146

[45] Jun. 9, 1981

[54] CONNECTOR FOR A RING CIRCUIT OF A BUS-SYSTEM

[75] Inventors: Ernst-Ulrich Simon, Oberursel; Horst Ullrich, Schöneck, both of Fed. Rep. of Germany

[73] Assignee: VDO Adolf Schindling AG, Frankfurt am Main, Fed. Rep. of Germany

[21] Appl. No.: 46,599

[22] Filed: Jun. 7, 1979

[30] Foreign Application Priority Data

Jul. 7, 1978 [DE] Fed. Rep. of Germany ..... 2829849
Jul. 7, 1978 [DE] Fed. Rep. of Germany ..... 2829850

[51] Int. Cl.[3] ..... H01R 23/70

[52] U.S. Cl. ..... 339/99 R; 339/147 R; 339/176 MP

[58] Field of Search ..... 339/147 R, 99 R, 176 MP, 339/97 R, 98

[56] References Cited

U.S. PATENT DOCUMENTS 2,802,083 8/1957 Lapeyre ..... 339/99 R X
3,680,032 7/1972 Mosier et al. ..... 339/99 R X
4,072,379 2/1978 Towne et al. ..... 339/99 R X

*Primary Examiner*—Mark Rosenbaum
*Attorney, Agent, or Firm*—Martin A. Farber

[57] ABSTRACT

A connector for a ring circuit of a bus-system with a plurality of connectable information sending and/or information receiving units, whereby the connector has a housing with several plug contacts provided with cutters, which cutters cut through the insulation of the ring circuit for the contacting and which are connectable with an information sending and/or information receiving unit, and under circumstances with a consumer. The housing which receives the plug contacts is constructed as a connector upper part which can be slipped on the ring circuit and under certain circumstances additional lines. The information receiving unit is constructed with use of a printed board assembly and is housed in a capsule which is able to be slipped on the upper part of the housing. The plug contacts have contact surfaces which contact the connection surfaces of the printed board assembly.

9 Claims, 12 Drawing Figures

CONNECTOR FOR A RING CIRCUIT OF A BUS-SYSTEM

The invention relates to a connector for a ring circuit of a bus-system with a plurality of connectable information sending and/or information receiving units, whereby the connector has a housing with several plug contacts provided with cutters, which cutters cut through the insulation of the ring circuit for the contacting and which are connectable with an information sending and/or information receiving unit, and under circumstances if necessary with a consumer.

Bus systems with a ring circuit or a ring cable are used in an increasing degree in spacially limited systems with information sending and/or information receiving units which are distributed or partitioned in the device, in order to make possible a data exchange between these units with the lowest possible cabling expense. For the connection of the information sending and/or information receiving units which constitute the subscriber of the bus system, it is not necessary in advantageous manner to undo the ring circuit or the ring cable. Moreover it suffices to cut or separate through the insulation to the data carrier line and from time to time if necessary additional lines to a ground line, in order to contact the electrically conducting core of the line with the information sending and/or information receiving unit. Additional contactings must be provided to a current supply of the subscriber units, as well as to stub lines which lead to the actual consumer, for example a measuring device or indicated value transmitter as a transmitter.

A known possibility to connect the information sending and/or information receiving units with the ring circuit resides in removing the insulation from the ring circuit with a tool in order to contact the core of the ring circuit. This way however is time consuming and troublesome, and the danger exists that the core is even damaged during the undoing or ripping of the insulation, so that in the worst case indeed a point of fracture of the line occurs without being wanted.

Even plug contacts (plugs) are part of this state of the art, which are provided with cutters or knife-edges for the automatic cutting through of the insulation of the ring circuit. After cutting through the insulation by means of the cutters they come directly into contact with the metallic core in order to connect the ring line with the unit which is connected to the plug. In this connection it is even known to combine several plugs into one housing so that several lines simultaneously can be contacted. However cables are to be soldered on the ends of the plugs and to be led out from the housing in order to produce the connection between the plugs and the information sending and/or information receiving unit which is separated from them.

This connection to several plugs which are accommodated in one housing is thus likewise still relatively cumbersome and time consuming to carry out. Moreover mistakes or confusion with the connection of the information sending and/or information receiving unit to the plugs can occur so that with the connection of these elements particular attention is required.

The present invention is based on the object and the task to further form a connector or plug for a ring circuit of the introductory-mentioned type while avoiding the disadvantages of the known connector such that the contacting between the ring circuit or line and additional lines provided if necessary from time to time under the circumstances, such as lines for the current supply or stub lines for the connection of consumers or transmitters on the one hand and the information sending and/or receiving unit which is constructed as a rule with electronic components on the other hand, is undertaken as simply, quickly and reliably as possible. Moreover the connector should have as compact a construction as possible.

It is another object of the present invention to aid in the solution of the above-mentioned object with a connector of the introductory-mentioned type in the manner that the housing which receives the plug contacts (8 to 14) is constructed as a connector upper part (2) which can be slipped on the ring circuit (54 to 57) and under circumstances if necessary additional lines (58 to 60), that the information sending and/or information receiving unit is constructed with use of a printed board assembly (4) and is housed in a capsule (3) which is able to be slipped on the upper part of the housing, and that the connector plug contacts (8 to 14) have contact surfaces (15, 16) which contact the connection surfaces of the printed board assembly (4), and for the unmistakable and non-interchangeable connection of a capsulated electronics onto a connector lower part, on the upper outer edge (38) of the connector upper part (2) and on the lower inner edge (39) of the caspule (3) there are formed projections (42 to 44) and grooves (45 to 51) which fit in one another on the lower inner edge (39) of the capsule (3) for the non-interchangeability of the capsule and of the associated connector upper part. In this manner interchanges or mistakes are avoided without deliberation. If for example six projections and grooves which fit in one another are provided, there result $2^6$ possibilities of different configurations of the projections and grooves and a corresponding number of non-interchangeable connection possibilities of the encapsulated units on corresponding connector lower parts.

For the production of such type of caps and connector upper parts with projections and grooves there can be formed from one of these two parts the maximum provided number of grooves from the beginning during the production and the grooves (which become excessive or undesired) can be filled with riders or slides, blocklets or other filling means, that is the grooves which are excessive and respectively undesired for the coding by the coordination of the projections and grooves. This filling-up of the over-abundant or excessive grooves however is cumbersome and under circumstances even not reliable, as the runners or blocklets under the circumstances can again subsequently fall out from the projections.

Advantageously important however is an embodiment by which on one wall section on the outer edge (38) of the connector upper part (2), there are provided an arrangement of a number of breakable-off projections (40 to 45, respectively), and respectively, on a wall section on the inner edge (39) of the cap, an arrangement of an equal number of grooves (45 to 50), which grooves are closed with breakable-off closure pieces (85 to 90) or on the other hand are injected in such a manner that after breaking off of projections and/or closure pieces, the cap (3) and the connector upper part (2) can be assembled for production of an integral or one piece connection.

Consequently it is achieved that for all configurations of projections and grooves which fit in one another, one can start out from identical upper parts and caps. The configuration of projections and grooves, and the coding, respectively, which configuration is selected for each connector, then is produced in a simple manner, such that from the given number of projections, certain projections can be broken off and that the grooves which are coordinated to the remaining projections during the later pushing together are opened by breaking off their closure pieces, while at the places of the broken-out projections the closure pieces remain in front of the grooves. The removal of the excessive, and respectively, disturbing projections and closure pieces can be brought about by means of breaking off or cutting out.

After the removal of the projections and/or closure pieces which are excessive for a certain configuration, the cap at the wall section (which wall section is pushed over the corresponding wall section of the connector upper part) has at each place such an open inner width that it nowhere abuts the wall section of the connector upper part in a way which hinders the slipping-on.

The connector with the cap and the connector upper part thus according to a uniform method of production and uniform molds are prepared in a less expensive manner such that subsequently by means of coding of corresponding projections and grooves they can be formed or converted in the simplest manner possible to complementary fitting or matched yet non-interchangeable parts.

In a further formation of the invention the connector has the features that one wall section (71 to 77) to the connector upper part directly adjacent to the projections has a reduced wall thickness compared to the wall section (80) in the further region of the projections, which latter wall section is only so thick so that the cap with its wall section (which section is provided with grooves) can be slipped on the upper part. By the reduced wall thickness directly adjacent the projections a tool can be engaged so deeply on the projection which is to be removed such that with safety no break points project so much that they impede slipping the cap on the connector upper part. The removal of the projections is consequently non-critical and as a rule requires no after treatment of the break surface.

In an advantageous manner the connector upper part and the cap are made of a synthetic material made from polyoxymethylene polymerisate.

This synthetic material on the one hand guarantees a sufficient rigidity and strength of the cap and of the connector upper part, yet on the other hand makes possible without application of too large forces the removal of the projections and the closure pieces which are to be broken off.

According to a further concept of the invention on the printed board assembly (4) two approximately L-shaped contact clip springs (71', 72') are mounted parallel spaced from one another, of which contact clip springs each one leg (e.g. 77') for insertion of a fuse (70) is arranged toward a lower open edge of the cap in such a manner that the fuse is accommodated in a space (78') in he cap (3), which space is free from the information sending and/or receiving unit and is accessible from the outside with the cap pulled-off from the housing upper part (2).

Consequently in an advantageous manner the fuse (which fuse is provided for prevention of disturbance of the bus system by a short circuit in a unit which is connected to the ring circuit or a section of the ring circuit and is coordinated to the respective unit) is accommodated in the free space which is not used by the electronic switching circuit of the information sending and/or information receiving unit. While the fuse with the cap mounted on the housing upper part is completely protected against environmental influences, the fuse with removed cap is conveniently reached through the opening of the cap, in order to be able to be exchanged in the case of a defect. The contact clip springs which are mounted on the printed board assembly serve for routing the current fluxes via the fuse to the construction elements which contact the printed board assembly, and respectively, to the connector contact plugs with which the printed board assembly is connected. The construction of the connector with such a solution remains compact as before.

In a particularly suitable embodiment of the connector, the latter has the feature that the approximately L-shaped contact clip springs (71', 72') are led through an insulation plate (79'), which plate limits the space (78') inside the cap (3) (which space is accessible from the outside and receives the fuse) from the space (between the boundaries 5, 6) inside of the cap, which latter-mentioned space receives the information sending and/or receiving unit.

By this separation with the insulation plate, with a removed cap the fuse can easily be removed from the latter, without unintentionally being engaged in the construction elements which are accommodated on the printed board assembly. For removal of the printed board assembly from the cap, the insulation plate yet can be removed so that the printed board assembly without more may be pulled out from its guide inside the cap.

The connector which receives the insulation plate is suitably further formed in the manner that the insulation plate (79') is pressed against ribs (80', 81'), which are formed out of the inner wall (82') in the space (between the boundaries 5, 6) of the cap, which space receives the information sending and/or receiving unit.

By engagement on the ribs thus the insulation plate exactly assumes the desired position, so that it can not be pressed into the space with the electronic components which are applied on the printed board assembly plate.

If the lower inner edge of the cap has projections and grooves which fit in corresponding grooves and projections on the upper outer edge of the connector upper part, the projections of the cap also can be formed such that they serve for engagement or abutment of the insulation plate. Then as in the embodiment form with separate ribs the insulation plate is pressed against the projections and pressed together so that the insulation plate indeed can be voluntarily removed, however it cannot fall out from the desired position by itself.

With the above and other objects and advantages in view, the present invention will become more clearly understood in connection with the detailed description of preferred embodiments, when considered with the accompanying drawings, of which:

Figure 1:
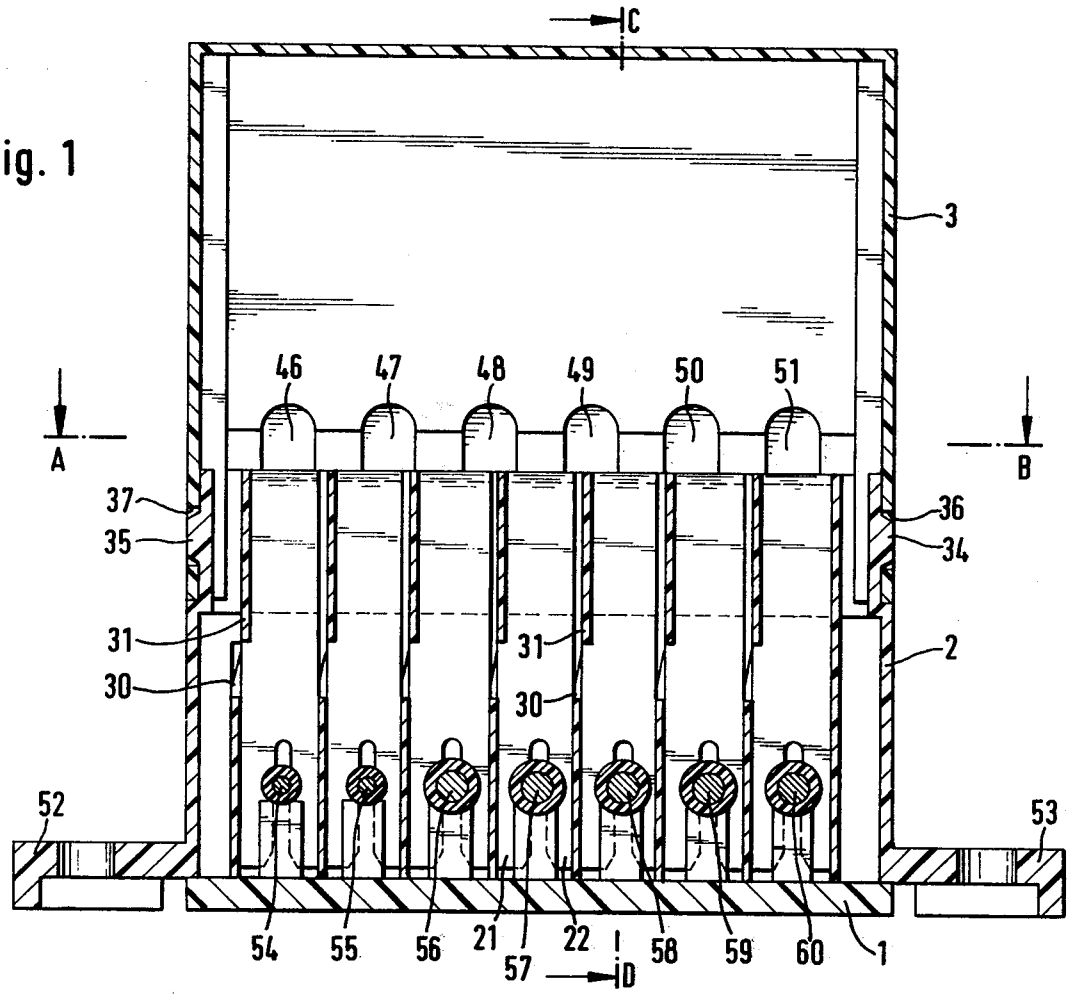
FIG. 1 is an enlarged illustration of a complete connector in a longitudinal section.

Referring now to FIG. 1 of the drawings, a base-shaped or socket-shaped lower part 1 of the connector is illustrated, as well as an upper part 2 which can be slipped onto the lower part and which can be clipped into the lower part, and an encapsulation or capsule 3 which can be slipped onto the upper part of the connector and which can be clipped into the connector upper part.

A printed board assembly 4 is rigidly arranged in the interior of the capsule 3, which printed circuit plate 4 is connected with electronic components, such as e.g., integrated switching circuits and relays. These electronic components are accommodated inside of the boundaries 5, 6. The printed board plate is provided with connection surfaces (not illustrated) which are applied on a section 7 of the printed board assembly, which section 7 projects from the boundaries 5, 6.

Figure 3:
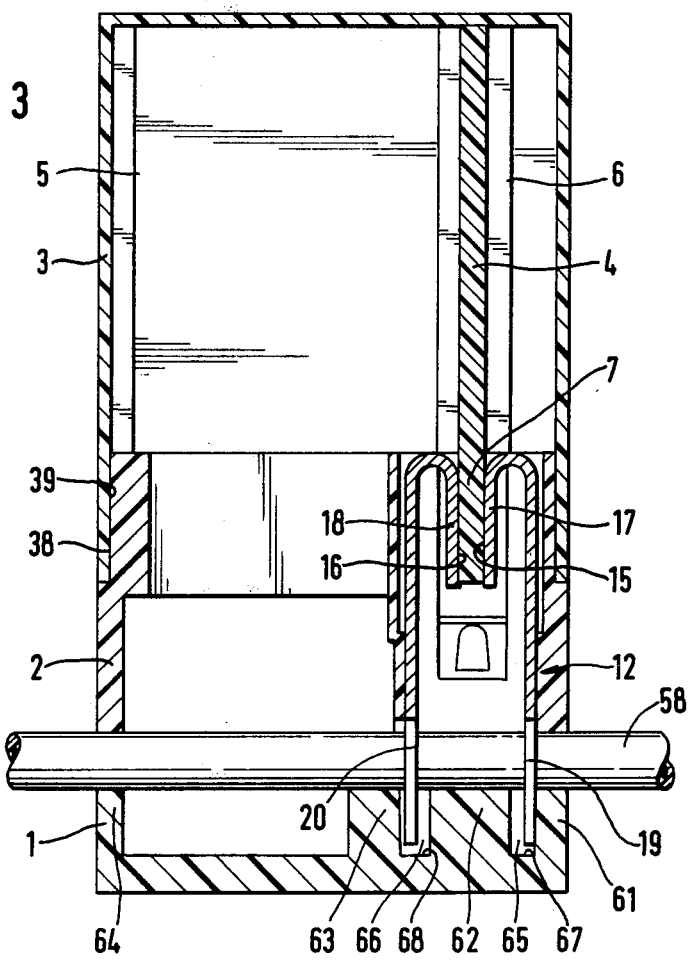
FIG. 3 is a section taken along the lines C—D in FIG. 1.
Figure 4:
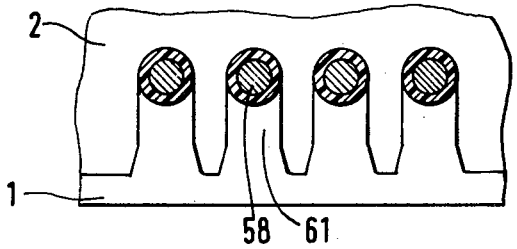
FIG. 4 is a cut-out view of the front side of the connector.

Each connection surface of the printed circuit plate board assembly 4 is contactable with one of the plug contacts (plugs) 8, 9, 10, 11, 12, 13, 14. The printed board assembly plate 4 is clamped-in between two legs 17, 18 in FIG. 3, which legs form contacting surfaces 15, 16. The legs extend on the side which is opposite to the contacting surface into respectively each one cutter or knife edge 19, 20 in FIG. 3. FIG. 1 shows the form of these edges which are formed between two blades or tongues 21, 22, which tongues lie in one plane.

Each of the plug contacts 8–14 is housed in an associated chamber 23, 24, 25, 26, 27, 28, 29 here in the upper part 2 of the connector so that each plug contact is isolated or insulated with respect to the adjacent plug contact. Each plug contact is held in its position in the chamber and is secured by a tongue section against unintentional sliding out from the chamber. In FIG. 1 the tongue section 30 corresponding to the plug contact 12 projects into an opening of a wall 31 in the chamber.

Figure 2:
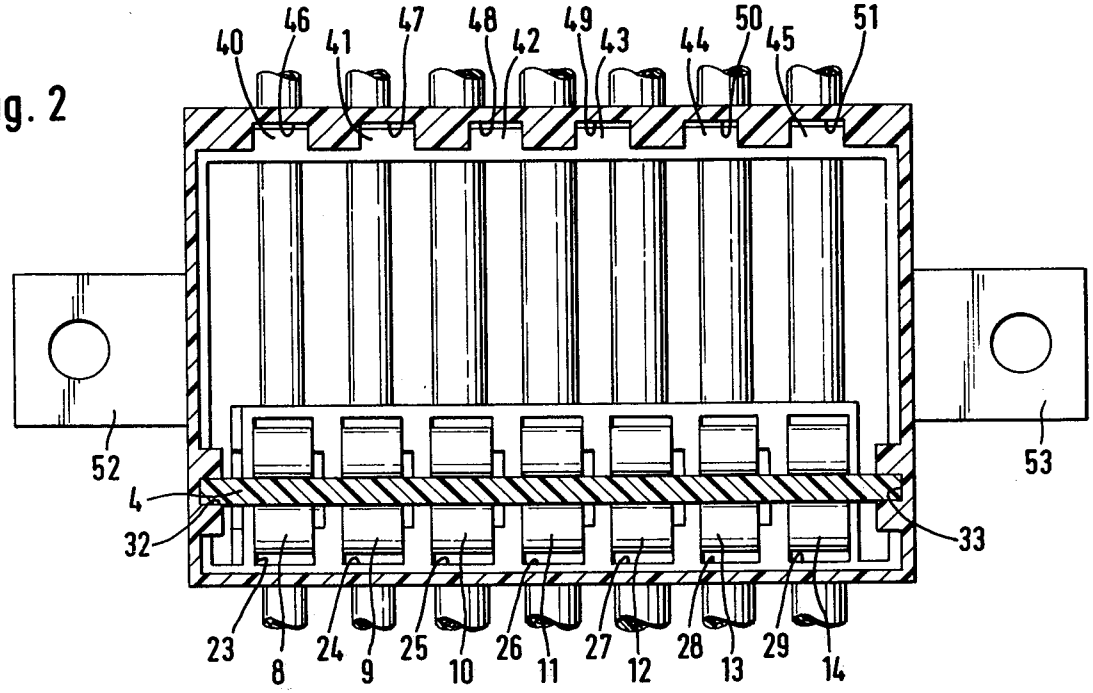
FIG. 2 is a cross-section taken along the lines A—B in FIG. 1 of the connector.

It is recognizable in FIG. 2 that the printed board plate 4 is inserted in two inner guide grooves 32, 33, which grooves are formed from the capsule 3, so that the printed board assembly is precisely alignable with respect to the plug contacts, particularly with respect to the contacting surfaces of the plug contacts.

The capsule 3 can be slipped on the correspondingly fitting connector upper part 2, whereby by means of respectively each one catch projection 34 and 35, respectively (which catch projection projects from the upper part of the connector) and a corresponding opening 36 and 37, respectively in the capsule there arises a clipping connection between the capsule and the upper part of the connector, which cannot be released unintentionally, for example, with vibratory stresses.

The shape of the upper outer edge 38 of the upper part 2 of the connector is adjusted or complementary to the shape of the lower inner edge 39 of the capsule 3. For the certain, positive non-interchangeable and non-mistakeable coordination of the electronics which are housed in the capsule (,which electronics constitute an information sending and/or information receiving unit), to the upper part 2 of the connector there are formed from the lower inner edge 39 of the capsule 3 and from the upper outer edge 38 of the upper part 2 of the connector, projections 40 to 45 and grooves 46 to 51 which fit in one another complementarily. In FIG. 2 a combination of six projections and grooves are represented. By eliminating one or several projections and grooves at the predetermined positions, altogether totally $2^6$ combinations are formed.

From FIGS. 1 and 2 moreover it can be recognized that the connector upper part can be screwed tightly to a carrier (not illustrated) by means of fastening flanges 52, 53 formed or connected thereon.

Thereby the connector upper part envelopes or surrounds the base-shaped lower part 1, the latter being supported on the carrier. An arrangement of elevations towers or projects straight up from the connector lower part for each line 54-60 to be received; in FIG. 3 the elevations 61, 62, 63, 64 are illustrated.

Between the elevations 61, 62 and 62, 63, respectively, there is formed respectively each one intermediate space 65 and 66, respectively, with a lower surface 67 and 68, respectively, so that respectively each one knife edge 19, 20 can project into the intermediate space up to closely above the bottom when the upper part 2 of the connector is fastened on the lower part 1 of the connector.

Before the fastening of the upper part of the connector onto the base-or socket-shaped lower part of the connector, the lines which are to be contacted are supported and rest on the elevations of the lower part 1 of the connector. In FIGS. 1 and 2 these lines are a data carrier line 54, a ground line 55, current supply lines 56 and 57, as well as output lines 58, 59 and 60 to a consumer (not illustrated). From these the lines 54, 55, 56, 57 form a ring circuit.

For the direct contacting of all these lines with the printed board assembly plate 4, at first the lines are supported on the elevations of the base-shaped lower part 1. Subsequently, then the upper part 2 of the connector is slipped thereon and screwed tightly on the carrier. Thereby the knife edges of the plugs (plug contacts) cut into the insulation of the lines until they reach the metallic relatively hard core of the lines and produce contact. The plug contacts thereby are pushed up to the position illustrated in FIG. 1. Subsequently, the electronics with the capsule 3 can be plugged onto the upper part of the connector, the electronics forming a module or an information sending and/or information receiving unit. Thereby the projecting section 7 of the printed board assembly 4 is guided between the legs of the plug contacts, and contact is produced between the contacting surfaces of the plug contacts and the connection surfaces of the printed board assembly, so that all lines including the lines 58, 59, 60 to the consumer are connected with the electronics without separate additional contacting. There is formed thereby a compact rigid or strong unit of the encapsulation of the connector upper part and the connector lower part. It is also conceivable to apply the capsule 3 together with the connector upper part on the lines on the connector lower part with production of the screwing connectionof the fastening flanges 52, 53 on the carrier (not illustrated), whereby simultaneously in the described manner a positive and sure contacting between all lines and the plug contacts take place, whereby the contacting between the plug contacts and the printed board assembly is already produced.

Figure 6:
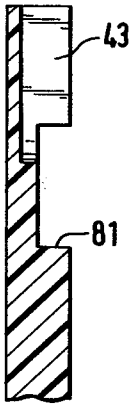
FIG. 6 is the cut-out according to FIG. 4 as a cross-section through the wall of the upper part of the connector.
Figure 5:
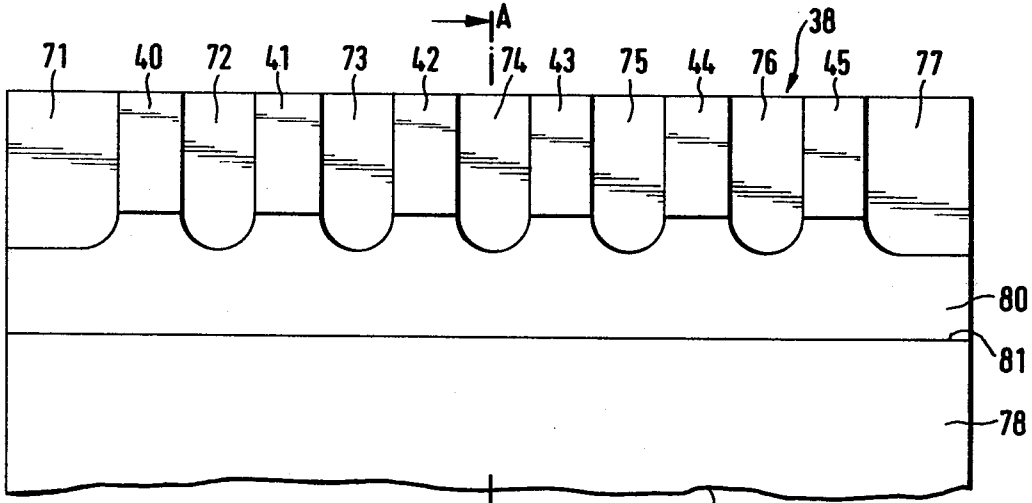
FIG. 5 is a side view showing the cut out from the upper part of the connector.
Figure 7:
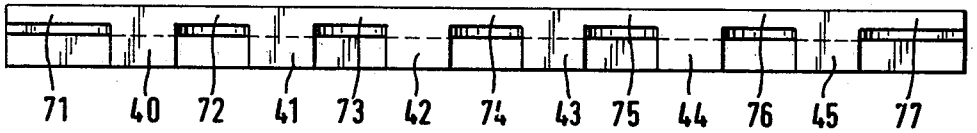
FIG. 7 is a view of the cut-out according to FIG. 4 from above.

In FIGS. 5 to 7 the upper part 2 of the connector in the range of the outer edge 38 is illustrated in detail. FIGS. 5 to 7 show how the six projections 40 to 45 are injection molded into the upper part of the connector, so that they project on wall sections 71 to 77 with reduced wall thickness, the wall sections 71 to 78 being opposite to the outer edge 38. The projections have a wall thickness as large as the wall 78 of the connector upper part, which wall 78 is shown brokenoff along a line 79. In another surrounding or region a section 80 is associated with the projections, the wall thickness of which section being greater than that of the wall sections with reduced wall thickness, however, small than the normal wall thickness of the wall 78. The wall thickness in the section 80 is only large enough so that the cap can be slid on this connector upper part up to the edge 81.

The wall sections 71 to 77 with reduced wall thickness are provided for the driver or attachment of a tool in order to break off individual projections for the coding of the connector upper part, so that the breakage in no case projects beyond the height of the wall section 80.

Figure 9:
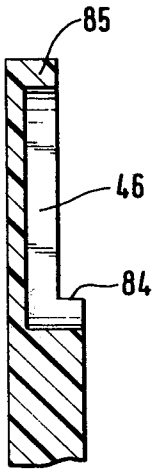
FIG. 9 is a cross-section through the wall in the cut-out of the cap according to FIG. 7.
Figure 8:
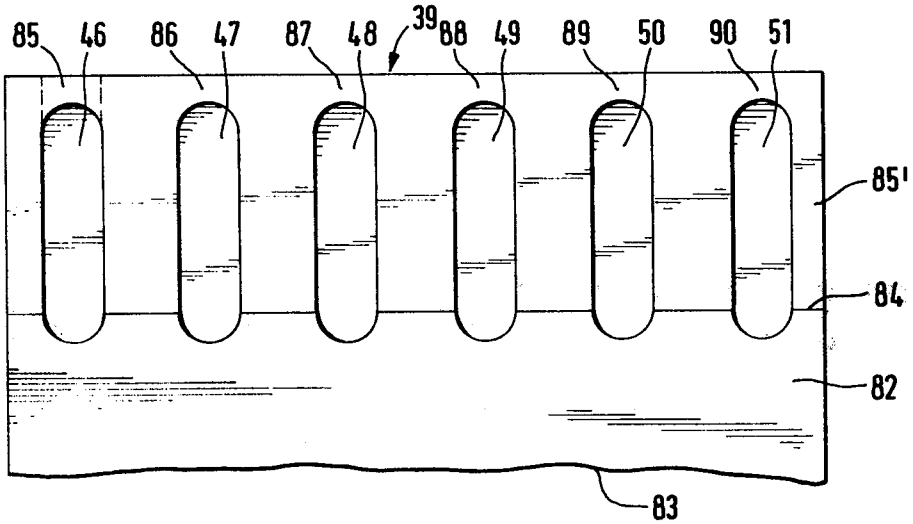
FIG. 8 is a side view of a cut-out from the cap.
Figure 10:
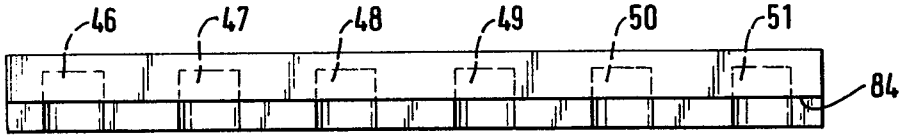
FIG. 10 is a view of the cut-out portion of the cap from above.

In FIGS. 8 to 10 the grooves 46 to 51 are shown arranged on the inner edge 39 of the cap in a cap wall 82, which cap wall extends up to the break line 83. Each groove is closed off by a closure piece 85, 86, 87, 88, 89, 90 which closure piece in extension of the groove leads to the inner edge. The grooves lie with their predominant part in a wall section 85', the thickness of which is reduced compared to the thickness of the cap wall 82 such that the cap with this wall section 85' can be slid on the upper part 2 of the connector, and indeed on the wall section 80, until the edge 84 of the cap engages against the edge 81 of the connector upper part, the wall section 85' leading up to the edge and edges 84, respectively.

The coordination of a cap 3 to a connector upper part 2 is provided in the manner that those closure pieces 85 to 90 are removed which close a groove in which one of the remaining projections 40 to 45 of the connector upper part is supposed to be inserted. If for example the projections 40, 41, 42, 43 and 44 are broken off from the connector upper part 2, so that only the projection 45 remains, thus the closure piece 90 in front of the groove 51 is to be removed from the cap, while the remaining closure pieces 85 to 89 remain.

In this way it is possible to satisfy a large plurality of different projections and corresponding open groove arrangements, respectively, in order to produce unmistakeable and non-interchangeable coordinations between the connector upper part and the cap.

If this large plurality still should not suffice, it is possible to increase the number of projections in one part and grooves in the other part.

The projections can be provided in the cap even in another embodiment form of the connector, while the grooves which are closed off with the closure pieces are injected into the connector upper part.

As synthetic material for the upper part of the connector and the cap, polyoxymethylene polymerisate is provided, which has favorable physical properties.

Figure 11:
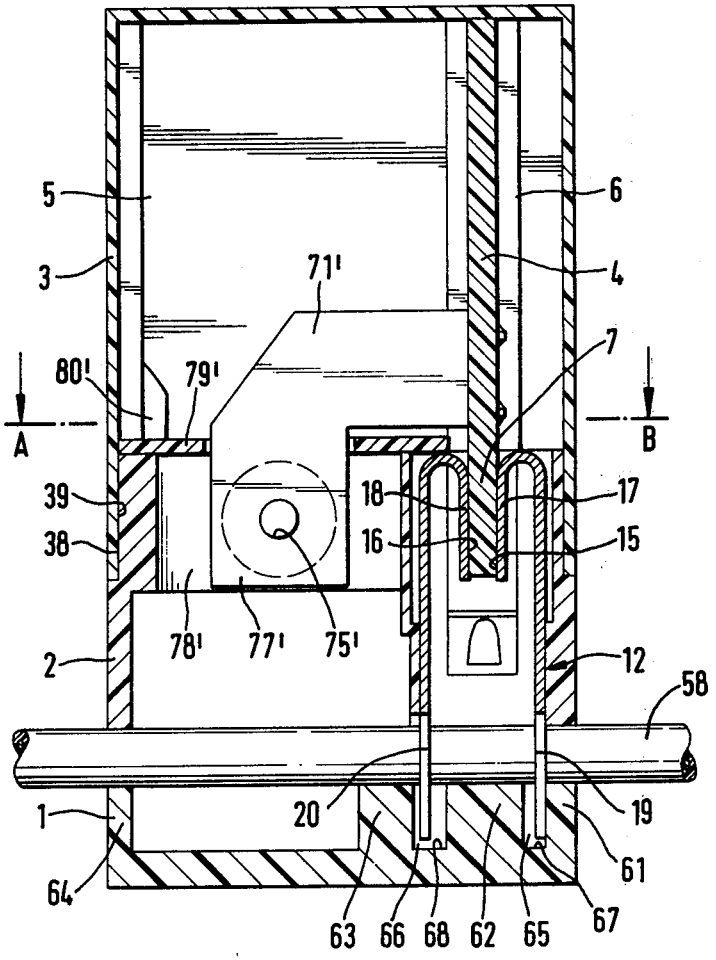
FIG. 11 is a perpendicular section of the connector.
Figure 12:
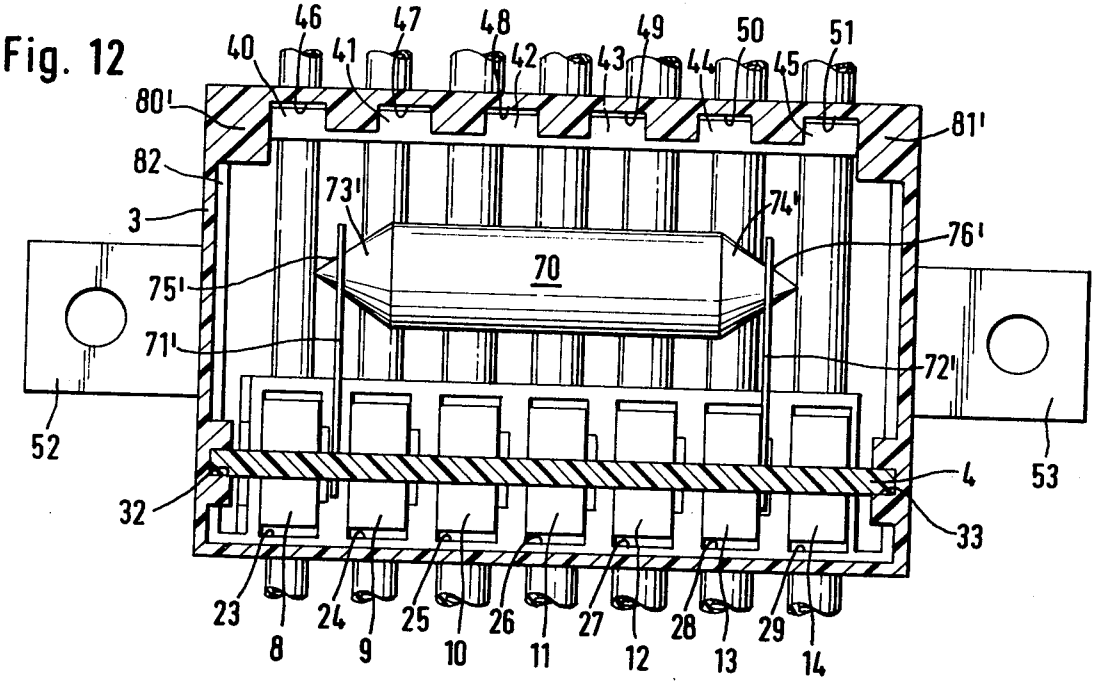
FIG. 12 is a cross-sectional view of the connector.

It is evident from FIGS. 11 and 12, how, for the accommodation of a fuse 70, two approximately L-shaped contact clip springs 71', 72' are soldered paralle' to one another on the printed board assembly 4, so that the fuse with its contact caps 73', 74' can be plugged respectively into each one bore 75', 76' in the respective contact clip springs and is held resiliently between the contact clip springs.

The approximately L-shaped contact clips are fastened on the printed board assembly in such a manner that a leg 77' (which leg runs parallel to the printed board plate) of the contact clip spring from the space which is bound by the boundaries 5, 6 (in which space the electronic components of the information sending and/or receiving unit are housed), projects into a free space 78', which space 78' is located in the vicinity of the lower edge inside of the cap.

An insulation plate 79' is pressed into the inside of the cap for dividing or bounding the space which is limited by the boundaries 5, 6 for the reception of the electronic components, from the free space 78' (in which space 78' only the fuse and the legs which hold the fuse are accommodated) of the contact clip springs. For holding it in its exact position the insulation plate 79' engages or lies on ribs 80', 81'.

The insulation plate is pressed against these ribs such that even during shaking or vibration of the connector, it cannot fall out from its desired position, yet such that it can be removed on the other hand at will when the printed board assembly 4 is to be pulled-out from the inside of the cap for an exchange or a repair.

While there has been disclosed several embodiments of the invention, it is to be understood that these embodiments are given by example only and not in a limiting sense.

We claim:

1. In a connector for a ring circuit of a bus-system with a plurality of connectable information sending and/or information receiving units, the connector having a housing with several plug contacts provided with cutters, which cutters cut through the insulation of the lines of the ring circuit for contacting the lines and which are connectable with at least an information sending and/or information receiving unit, the improvement wherein the housing receiving the contact plugs is constructed as a connector upper part which is able to be slipped on the ring circuit, a printed board assembly forming the information sending and/or information receiving unit and having connection surfaces, a capsule slipable on said connector upper part of the housing and housing said unit, the plug contacts have contact surfaces which contact said connection surfaces of said printed board assembly, a plurality of projections formed on an upper outer edge of said connector upper part, and said capsule has a lower inner edge forming a plurality of grooves, respective of said projections fit in only one specific of said grooves respectively on said lower inner edge of said capsule and cooperatively define a singular predetermined combination means for non-interchangeability of the capsule and of the associated said connector upper part in only one relative position.

2. The connector as set forth in claim 1, wherein said outer edge of said connector upper part has a first wall section, said first wall section is formed with an arrangement of a number of said projections, the latter being breakable off said outer edge, said inner edge of said capsule has a second wall section, said second wall section is formed with an arrangement of a number of said grooves equal to the number of said projections, closure pieces close said grooves and are breakable off from said inner edge such that after breaking off selected of said projections and/or said closure pieces said capsule and said connector upper part are assembleable for production of an integral connection.

3. The connector as set forth in claim 2, wherein said connector upper part has at least one wall section directly adjacent to said projections and another wall section in a further region of said projections, said at least one wall section has a wall thickness smaller than that of said another wall section, said another wall section is only so thick that said capsule with said second wall section thereof with said grooves therein is slippable on said connector upper part.

4. The connector as set forth in claim 2 or claim 3, wherein said connector upper part and said capsule are made of synthetic material made from polyoxymethylene polymerisate.

5. The connector as set forth in claim 1, further comprising two approximately L-shaped contact clip springs are mounted parallel to and spaced from one another on said printed board assembly, said contact clip springs have legs, respectively, constituting means for insertion of a fuse, each said leg is arranged toward a lower edge of said capsule in such a manner that the fuse is accommodated in a free space in said capsule, said space being free from the information sending and/or receiving unit and being accessible from the outside with said capsule pulled-off from the connector upper part of the housing.

6. In a connector for a ring circuit of a bus-system with a plurality of connectable information sending and/or information receiving units, the connector having a housing with several plug contacts provided with cutters, which cutters cut through the insulation of the lines of the ring circuit for contacting the lines and which are connectable with at least an information sending and/or information receiving unit, the improvement wherein the housing receiving the contact plugs is constructed as a connector upper part which is able to be slipped on the ring circuit, a printed board assembly forming the information sending and/or information receiving unit and having connection surfaces, a capsule slipable on said connector upper part of the housing and housing said unit, the plug contacts have contact surfaces which contact said connection surfaces of said printed board assembly, two approximately L-shaped contact clip springs are mounted parallel to and spaced from one another on said printed board assembly, said contact clip springs have legs, respectively, constituting means for insertion of a fuse, each said leg is arranged toward a lower edge of said capsule in such a manner that the fuse is accommodated in a free space in said capsule, said space being free from the information sending and/or receiving unit and being accessible from the outside with said capsule pulled-off from the connector upper part of the housing.

7. The connector as set forth in claim 1 or 6, wherein the contact surfaces contact the connection surfaces of printed board assembly during slipping said capsule on said connector upper part.

8. The connector as set forth in claim 6 or 5, further comprising said capsule has boundaries defining a first space therebetween inside said capsule, said information sending and/or receiving unit is received in said first space, an insulation plate disposed in said capsule limiting said free space inside said capsule from said first space, said approximately L-shaped contact clip springs are led through said insulation plate.

9. The connector as set forth in claim 8, wherein said capsule has an inner wall, ribs are formed out from said inner wall of said capsule in said first space between said boundaries of said capsule, said insulation plate is pressed against said ribs.

* * * * *